United States Patent [19]

Kapfer et al.

[11] Patent Number: 4,619,227

[45] Date of Patent: Oct. 28, 1986

[54] IGNITION DISTRIBUTOR ARRANGEMENT FOR INTEGRAL-COMBUSTION ENGINES

[75] Inventors: Jürgen Kapfer, Renningen; Gerhard Kirchdorffer, Weissach-Flacht, both of Fed. Rep. of Germany

[73] Assignee: Dr. Ing. h.c.F. Porsche Aktiengesellschaft, Weissach, Fed. Rep. of Germany

[21] Appl. No.: 733,784

[22] Filed: May 14, 1985

[30] Foreign Application Priority Data

May 23, 1984 [DE] Fed. Rep. of Germany ..... 3419184

[51] Int. Cl.[4] ..... F02P 1/00

[52] U.S. Cl. ..... 123/146.5 A; 123/195 A

[58] Field of Search ..... 123/146.5 A, 195 A; 200/19 R, 190 C

[56] References Cited

U.S. PATENT DOCUMENTS

| | | | |
|---|---|---|---|
| 4,037,577 | 7/1977 | Gallo | 123/146.5 A |
| 4,082,926 | 4/1978 | Marks et al. | 123/146.5 A |
| 4,333,433 | 6/1982 | Mahson | 123/146.5 A |
| 4,349,007 | 9/1982 | Onishi | 123/146.5 A |
| 4,454,856 | 6/1984 | Fox | 123/146.5 A |

FOREIGN PATENT DOCUMENTS

| | | | |
|---|---|---|---|
| 3124177 | 6/1981 | Fed. Rep. of Germany | 123/146.5 A |
| 3027695 | 2/1982 | Fed. Rep. of Germany | 123/146.5 A |

OTHER PUBLICATIONS

Porsche 944 Information Pamphlet, p. 6.

*Primary Examiner*—Ronald B. Cox
*Attorney, Agent, or Firm*—Barnes & Thornburg

[57] ABSTRACT

An ignition distributor is arranged so that its axis is aligned with the central longitudinal axis of a camshaft. A generally cylindrical cam is attached to an end of the camshaft for driving a rotor of the ignition distributor. A flange on the cam extends transversely to the central longitudinal axis of the camshaft and is aligned with an extension of the rotor. Screws are provided to connect the flange and the extension. The screws extend in parallel to the longitudinal central axis of the camshaft and are distributed around the flange to balance the distribution of mass around the central axis. The cylindrical cam fits within an opening in a housing which is only slightly larger than the outside diameter of the cam to reduce the entry of dust into the distributor.

7 Claims, 2 Drawing Figures

IGNITION DISTRIBUTOR ARRANGEMENT FOR INTEGRAL-COMBUSTION ENGINES

BACKGROUND AND SUMMARY OF THE INVENTION

This invention relates to an ignition distributor arrangement for internal-combustion engines wherein the ignition distributor is fastened to the internal-combustion engine and is driven by a camshaft. The ignition distributor is aligned in the same direction as the axis of the camshaft and has a rotor which is substantially cylindrical in shape and which interacts with a cylindrical cam arranged at an end of the camshaft.

In a known arrangement of the above mentioned type (Porsche 944 Customer Service Information WKW 450 610, 07/81, Page 6), the rotor of the ignition distributor is arranged above the cam and is secured by a screw extending in a radial direction, i.e., transversely to the central longitudinal axis of the camshaft. A disadvantage of this arrangement is that the vibrations of the internal-combustion engine may cause loosening of the screw.

An object of this invention is to provide an improved ignition distributor arrangement wherein the fastening arrangement for the cam and the rotor securely withstands the vibrations occurring during the operation of the internal-combustion engine.

These and other objects are achieved in an ignition distributor arrangement for internal-combustion engines which comprises a generally cylindrical distributor rotor having a central longitudinal axis of rotation, and means for drivingly attaching the rotor to an end of the engine camshaft such that the central longitudinal axis of the rotor is aligned with a central longitudinal axis of the camshaft. In a preferred embodiment, a generally cylindrical cam is attached to the end of the camshaft by a screw. The cam has a flange which extends transversely to the central longitudinal axis of the camshaft. The rotor is fastened to the flange by means of an extension of the rotor, which is aligned with the flange, and one or more screws. The screws which attach the rotor to the cam are aligned such that their central longitudinal axis extends parallel to the central longitudinal axis of the camshaft. In an especially preferred embodiment, three spaced apart screws are used for fastening the rotor to the flange. In this embodiment, the rotor has an asymmetrical control finger. This control finger, the rotor extension, and the screws are arranged around the central longitudinal axis of the rotor so as to provide an essentially symmetrical distribution of mass around this axis, thus reducing vibrations when the engine is operating.

The outer diameter of the flange of the cam fits into an opening in a housing which surrounds a portion of the ignition distributor arrangement. The diameter of the opening is only slightly larger than the outside diameter of the flange.

The main advantages of the arrangement according to this invention are that a cam and rotor connection that is designed in this way is not loosened by vibrations occurring during operation of the internal-combustion engine. This result is due, at least in part, to the symmetrical distribution of mass at the rotor which avoids the occurrence of an unbalanced rotating mass.

Because the outside diameter of the flange is relatively close to the diameter of the opening, the rotor space is effectively closed with respect to the toothed-belt wheel space, making an additional dust cap unnecessary.

Other objects, advantages and novel features of the present invention will become apparent from the following detailed description of a preferred embodiment of the invention, when considered in conjunction with the accompanying drawings.

DETAILED DESCRIPTION OF THE DRAWINGS

Figure 1:
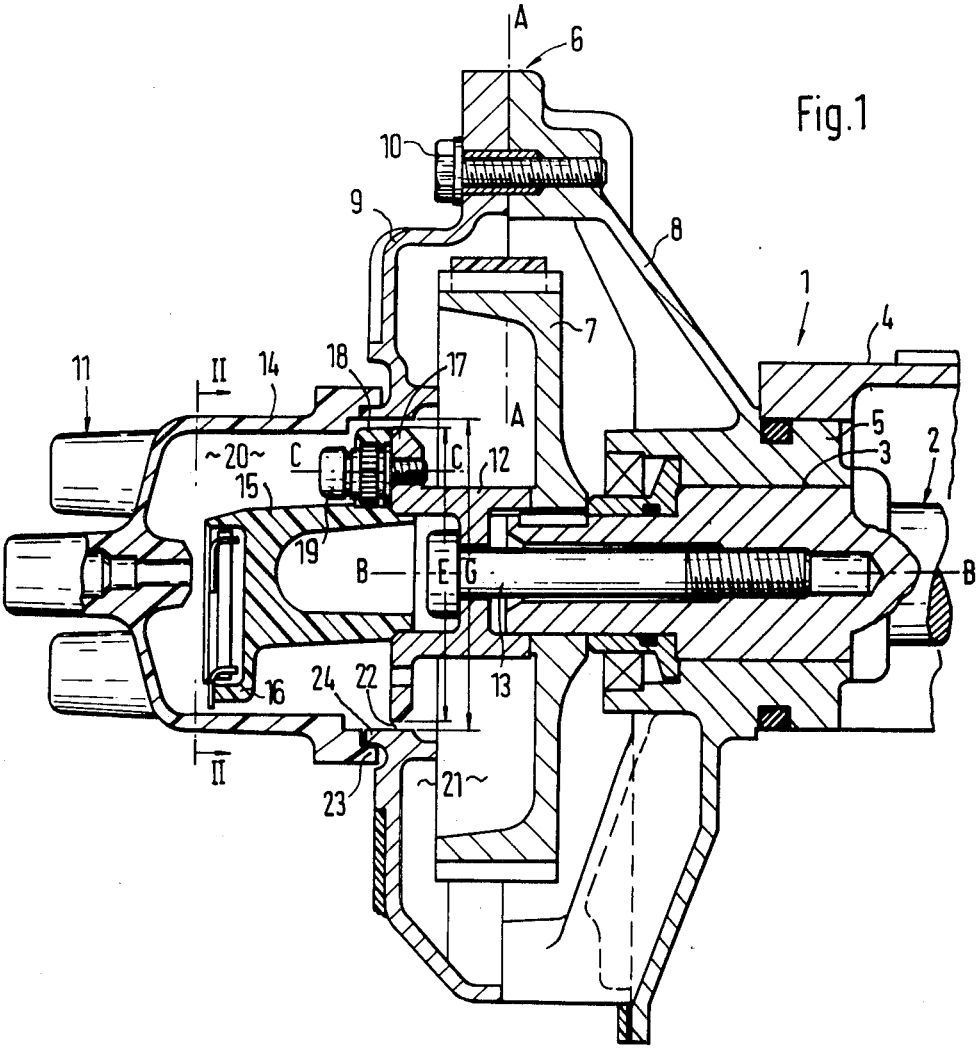
FIG. 1 is a partial longitudinal section of an internal-combustion engine in the area of the top camshaft.

Referring to FIG. 1, an internal-combustion engine 1, having valves that are not shown, comprises a top camshaft 2 having an end portion 3 disposed in an insert 5 in a camshaft housing 4. Insert 5 is part of a housing 6 which surrounds a toothed-belt wheel 7 used for driving camshaft 2. Housing 6 is formed of a receiving part 8, connected with the insert 5, and a closing part 9 which are fitted together in a vertical plane A—A and are connected together by means of screws 10.

In FIG. 1, an ignition distributor 11 is arranged so that its axis is aligned with the central longitudinal axis B—B of camshaft 2. Ignition distributor 11 is driven by camshaft 2. For this purpose, a cylindrical cam 12 is provided that is arranged behind camshaft 2 (to the left of the camshaft, as viewed in FIG. 1) and also behind toothed-belt wheel 7. Cam 12 and toothed-belt wheel 7 are connected to camshaft 2 in an axially and rotationally secure manner by a screw 13. Further details regarding this arrangement can be found in German Patent Specification No. 3 027 695.

Ignition distributor 11 has a housing 14 and a rotor 15. Rotor 15 has a generally cylindrical shape and an asymmetrical control finger 16.

On the side facing rotor 15, cam 12 has a flange 17 which extends transversely to the central longitudinal axis B—B of camshaft 2 and to which a corresponding extension 18 of rotor 15 is fastened. Cam 12 and rotor 15 are connected via a screw 19 which extends through flange 17 and extension 18. The central longitudinal axis C—C of screw 19 extends in parallel to the central longitudinal axis B—B of camshaft 2.

Figure 2:
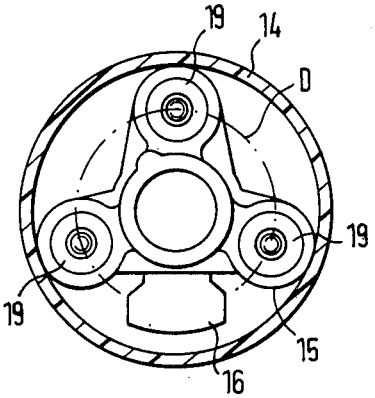
FIG. 2 is a section according to Line II—II of FIG. 1.

As shown in FIG. 2, three screws 19 are provided for fastening rotor 15 to cam 12. Screws 19 are distributed around a bolt circle D and arranged, relative to the asymmetrical control finger 16, in such a way that an essentially symmetrical distribution of mass results (i.e., rotor 15 is balanced).

To protect rotor space 20 of the ignition distributor 11 from dust penetrating from toothed-belt wheel space 21, the circular outside diameter E of flange 17 is only slightly smaller than the diameter G of a circular opening 22 of closing part 9 surrounding the flange.

Distributor housing 14, by means of a collar 23, is pressed onto a corresponding receiving means 24 of closing part 9.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

We claim:

1. An ignition distributor arrangement for internal combustion engines, comprising:

a generally cylindrical ignition distributor rotor having a central longitudinal axis of rotation;

means for drivingly attaching the rotor to an end of an engine camshaft such that the central longitudinal axis of the rotor is aligned with a central longitudinal axis of the camshaft, wherein said means for attaching the rotor to the camshaft includes a generally cylindrical cam attached to the end of the camshaft, said cam having a continuous flange extending transversely to the central longitudinal axis of the camshaft, and wherein said rotor is fastened to the flange by fastening means; and a housing having an opening which surrounds the continuous flange and which has a diameter which is only slightly larger than an outside diameter of the flange, whereby the flange acts as a dust cap to prevent contaminants from passing through the opening.

2. An ignition distributor arrangement for internal combustion engines, comprising:

a generally cylindrical ignition distributor rotor having a central longitudinal axis of rotation;

means for drivingly attaching the rotor to an end of an engine camshaft such that the central longitudinal axis of the rotor is aligned with a central longitudinal axis of the camshaft;

wherein said means for attaching the rotor to the camshaft includes a generally cylindrical cam attached to the end of the camshaft, said cam having a flange extending transversely to the central longitudinal axis of the camshaft; and wherein said rotor is fastened to the flange by fastening means comprising an extension of said rotor which is aligned with said flange, and at least one screw having a central longitudinal axis extending parallel to the central longitudinal axis of the camshaft and rotor; and wherein said rotor has an asymmetrical control flange, and wherein said screw, said extension and said control flange are asymmetrically arranged so as to provide an essentially symmetrical distribution of mass around the central longitudinal axis of the rotor.

3. An ignition distributor arrangement according to claim 1, wherein said fastening means for fastening the rotor to the flange comprises an extension of said rotor which is aligned with said flange, and at least one screw having a central longitudinal axis extending parallel to the central longitudinal axis of the camshaft and rotor.

4. An ignition distributor arrangement according to claim 3, wherein said rotor has an asymmetrical control flange, and wherein said screw, said extension and said control flange are arranged to provide an essentially symmetrical distribution of mass around the central longitudinal axis of the rotor.

5. An ignition distributor arrangement according to claim 3, wherein said fastening means includes three spaced apart screws for fastening the flange to the rotor extension.

6. An ignition distributor arrangement according to claim 5, wherein said rotor has an asymmetrical control flange, and wherein said screws, said extension and said control flange are arranged to provide an essentially symmetrical distribution of mass around the central longitudinal axis of the rotor.

7. An ignition distributor arrangement according to claim 2, wherein said fastening means includes three asymmetrically spaced screws for fastening the rotor extension to the flange.

* * * * *